US006715248B2

(12) United States Patent
Biebuyck

(10) Patent No.: US 6,715,248 B2
(45) Date of Patent: Apr. 6, 2004

(54) BUILDING CURTAIN WALL WITH SILL ANCHOR ASSEMBLY

(75) Inventor: Lawrence F. Biebuyck, Garland, TX (US)

(73) Assignee: Butler Manufacturing, Company, Kansas City, MO (US)

( * ) Notice: Subject to any disclaimer, the term of this patent is extended or adjusted under 35 U.S.C. 154(b) by 0 days.

(21) Appl. No.: 10/099,070

(22) Filed: Mar. 13, 2002

(65) Prior Publication Data

US 2002/0129573 A1 Sep. 19, 2002

Related U.S. Application Data

(60) Provisional application No. 60/275,570, filed on Mar. 13, 2001.

(51) Int. Cl.[7] ..... E04H 1/00

(52) U.S. Cl. ..... 52/235; 52/204.53; 52/212; 52/745.16

(58) Field of Search ..... 52/235, 211, 212, 52/204.53, 764, 765, 775, 781, 745.1, 745.16

(56) References Cited

U.S. PATENT DOCUMENTS

| | | | | |
|---|---|---|---|---|
| 2,949,981 A | * | 8/1960 | Ferrell | 52/235 |
| 3,016,993 A | * | 1/1962 | Owen | 52/204.591 |
| 3,205,630 A | * | 9/1965 | Felix et al. | 52/476 |
| 3,246,441 A | * | 4/1966 | Horgan, Jr. | 52/656.1 |
| 3,478,480 A | | 11/1969 | Swenson | |
| 3,858,375 A | * | 1/1975 | Silvernail | 52/235 |
| 3,932,974 A | | 1/1976 | Wright | |
| 3,936,986 A | | 2/1976 | Steel | |
| 3,978,629 A | | 9/1976 | Echols, Sr. | |
| 4,009,549 A | | 3/1977 | Hala | |
| 4,021,989 A | | 5/1977 | Hala | |
| 4,055,923 A | * | 11/1977 | Biebuyck | 52/235 |
| 4,194,333 A | | 3/1980 | Paton et al. | |
| 4,307,551 A | | 12/1981 | Crandell | |
| 4,519,173 A | | 5/1985 | Roberts | |
| 4,619,092 A | | 10/1986 | Kaminaga | |
| 4,633,631 A | | 1/1987 | Crandell | |
| 4,644,717 A | | 2/1987 | Biebuyck | |
| 4,724,637 A | * | 2/1988 | Evans | 52/209 |
| 4,773,193 A | | 9/1988 | Biebuyck et al. | |
| 4,783,941 A | | 11/1988 | Loper et al. | |
| 4,799,344 A | | 1/1989 | Francis | |
| 4,803,820 A | | 2/1989 | Metrick | |
| 4,817,351 A | | 4/1989 | Michlovic | |
| 4,841,700 A | * | 6/1989 | Matthews | 52/235 |

(List continued on next page.)

FOREIGN PATENT DOCUMENTS

| | | |
|---|---|---|
| DE | 1289289 | 2/1969 |
| FR | 1293557 | 4/1962 |

OTHER PUBLICATIONS

Kawneer Architectural Products/Amax Aluminum: Aluminum Curtain Wall and Window Manual, "Seamless Mullion 300T • 400T • 400", Jan. 1978 (16 pages).

YHC 200 OG Details; www.ykkap.com/pm/html/scaled.htm; Aug. 1, 2000.

*Primary Examiner*—Carl D. Friedman
*Assistant Examiner*—Brian E. Glessner
(74) *Attorney, Agent, or Firm*—Jenkens & Gilchrist, P.C.

(57) ABSTRACT

A method of and apparatus for curtain wall assembly utilizing a sill subassembly which is adapted for direct structural interconnection with oppositely disposed portions of vertical mullions. The oppositely disposed mullions and underlying sill subassembly are configured for direct mounting upon a pre-installed flashing secured to a structural mounting surface of a building. In this manner, threaded fasteners may be utilized to directly interconnect the vertical mullion to the sill subassembly and the mounting of panels, such as glass, to the sill subassembly is facilitated.

25 Claims, 5 Drawing Sheets

U.S. PATENT DOCUMENTS 4,873,806 A 10/1989 Jeschke
4,899,508 A 2/1990 Biebuyck
4,984,400 A 1/1991 Bockmiller
4,996,809 A 3/1991 Beard
5,036,637 A * 8/1991 Biebuyck ..... 52/235
5,065,557 A 11/1991 Laplante et al.
5,077,947 A 1/1992 Takeda
5,185,979 A 2/1993 Azzimonti
5,252,154 A 10/1993 Hoffman
5,253,459 A * 10/1993 Parinas et al. ..... 52/235
5,333,428 A 8/1994 Taylor et al.
5,354,410 A 10/1994 Cohen et al.
5,546,713 A 8/1996 Voegele, Jr. et al.
5,560,149 A 10/1996 Lafevre
5,592,795 A 1/1997 Rinehart et al.
5,596,851 A * 1/1997 Ting ..... 52/211
5,746,032 A * 5/1998 Koike et al. ..... 52/204.1
5,839,236 A 11/1998 Frey
5,937,597 A * 8/1999 Sono et al. ..... 52/204.1
6,158,182 A 12/2000 Biebuyck

* cited by examiner

BUILDING CURTAIN WALL WITH SILL ANCHOR ASSEMBLY

CROSS-REFERENCES TO RELATED APPLICATIONS

This Application for Patent claims the benefit of priority from, and hereby incorporates by reference for any purpose the entire disclosure of, U.S. Provisional Patent Application No. 60/275,570 filed Mar. 13, 2001.

FIELD OF THE INVENTION

The present invention relates to curtain walls used for building exteriors and, more particularly, but not by way of limitation, to methods of and apparatus for constructing, assembling and anchoring sill sections of such curtain walls and the curtain wall panels associated therewith.

HISTORY OF THE RELATED ART

Curtain walls are typically constructed of extruded aluminum frame support members having generally U-shaped channels (although other shapes may apply) for supporting a plurality of panel members that serve as the exterior of a building. Such panel members are most often panes of glass, and often double pane glass sections, but other paneled building materials such as aluminum, granite, slate, or concrete are also utilized. Such panel members are often of identical size and shape. However, near doors, opening windows, or other access points into the building, panel members of different sizes and shapes may be utilized.

More specifically, such curtain walls generally include a horizontal sill member having at least one portion forming an upwardly facing region (or channel) at the bottom of a wall section, a horizontal head member having a downwardly facing channel at the top of a wall section, and a plurality of vertical mullions running between the sill and head members. Panel members are supported by the channels of the sill member and the head member, and the vertical joints between adjacent panel members are formed at the mullions. In some designs, the mullions are disposed interiorly of the sill member, the head member, and the panel members so that only the joint between adjacent panel members, and not the mullions themselves, are visible from the exterior of the building. The designs do, however, vary, depending upon the desired aesthetics of the curtain wall construction. One such design is set forth and shown in U.S. Pat. No. 4,899,508, assigned to the assignee of the present invention.

Another curtain wall construction is set forth and shown in U.S. Pat. No. 6,158,182, also assigned to the assignee of the present invention. As set forth in the '182 Patent, multiple panel members 20 are typically arranged side-by-side and are secured and sealed between a sill member 10 and a head member, with their vertical joints overlapping at a mullion. This vertical joint must then be sealed from both the interior and exterior of the building using both resilient gaskets and/or structural silicone, as described for reference purposes below.

Referring now to FIG. 1, a schematic, cross-sectional view of sill member 10 of an exemplary, prior art curtain wall is shown. Sill member 10 secures a curtain wall to a structural support surface such as a concrete slab 12. The concrete slab 12 may be at ground level or comprising a floor surface of a high rise building. Although not shown in FIG. 1, a head member similar to sill member 10 secures the curtain wall to concrete slab between floors of a building or other building structures, and a plurality of mullions span between sill member 10 and the head member. Sill member 10 is typically formed as an integral aluminum extrusion. Sill member 10 also generally includes a channel section 14, an anchoring section 16 disposed interiorly of channel section 14, and a cover 18.

Still referring to FIG. 1, channel section 14 and cover 18 cooperate to secure a panel member 20 to sill member 10. More specifically, channel section 14 includes a base 14*a* and two legs 14*b* and 14*c* that form a upwardly facing U-shaped channel. A support member 22 rests on the top surface of base 14*a*. Leg 14*b* has a groove 24 proximate the upper end of its interior surface, and leg 14*c* has a support surface 26 proximate the upper end of its interior surface. Cover 18 has a downwardly depending resilient leg 28 that engages a groove 30 on the exterior surface of leg 14*c*. Cover 18 also has a tongue 32. Panel member 20 is supported within channel section 14 via setting block 34 and resilient gaskets 36 and 38. Setting block 34 is disposed on the top surface of support member 22. Resilient gasket 36 has a tongue 36*a* that engages groove 24 of leg 14*b*. Resilient gasket 36 is typically pre-installed in groove 24 of leg 14*b* during manufacturing of sill member 10. Resilient gasket 38 has a groove 38*a* that engages tongue 32 of cover 18 and a surface 38*b* that mates with surface 26 of leg 14*c*. Channel section 14 further includes a plurality of support legs 40 below base 14*a*.

Anchoring section 16 includes a base 16*a*, a leg 16*b*, and a plurality of support legs 42 below base 16*a*. Base 16*a* has a plurality of holes 44 spaced along its length for receiving bolts or fastening means 46, and the diameter of each hole 44 is substantially identical to the diameter of a threaded shank 46*a* of each bolt 46. Leg 16*b* has a groove 48 for receiving a tongue 49 of cover 18.

The following technique is typically used to install a panel member 20 of such a curtain wall. First, sill member 10 is laid on a shim 56 in the proper position on slab 12 and is used as a template to drill holes into slab 12 for each bolt 46. One should note that shim 56 does not run continuously along the length of sill member 10. Instead, shim 56 is used at low points of slab 12 to level sill member 10, if necessary. Second, sill member 10 is removed from shim 56, and a hole 50 with a larger diameter is drilled in the place of each of the holes drilled using sill member 10. Third, a structural insert 52 is secured within each of holes 50 via epoxy or other conventional means. Each insert 52 has an internally threaded hole 54 for receiving bolts 46. A preferred structural insert 52 is sold by HILTI® of Tulsa, Okla. Fourth, sill member 10 is repositioned on shim 56 and secured to slab 12 using bolts 46. Fifth, a sealant 58 is disposed on slab 12 along both the exterior and interior sides of shim 56. Sixth, a head member similar to sill member 10 is secured to part of the building structure using the above-described techniques. Seventh, vertical mullions are secured between sill member 10 and the head member at appropriate intervals along the curtain wall. Eighth, support member 22 is disposed on base 14*a* of sill member 10, and setting block 34 is disposed on support member 22. Ninth, panel member 20 is then installed from the exterior of the building, typically first being tilted into the channel section of the head member, and then being dropped into channel section 14 of sill member 10. Tenth, cover 18 is installed in sill member 10, and a glazing stop is installed in the head member of the curtain wall. Eleventh, resilient gasket 38 is disposed on tongue 32 of cover 18 of sill member 10, and a similar gasket is disposed on the tongue of the glazing stop of the head member.

While such curtain walls, and other conventional curtain walls, have proved to be reliable commercial building systems, they suffer from several drawbacks. For example, securing the curtain wall members to their corresponding building structure typically requires, as described above, multiple steps at the job site. The complexity of such steps is exacerbated by the frequent requirement of shimming a sill member 10 that is not yet assembled to oppositely disposed vertical mullions, and then completing the assembly process subsequent thereto. This both increases the cost of this process an requires a high degree of quality control. In addition, installing the panel members at the building site also requires inspections during the process. These inspections must be performed by building code enforcement personnel, whose schedule may or may not be compatible with time schedules for the contractor erecting such curtain walls. For this reason, it would be greatly advantageous to provide a method of and apparatus for curtain wall construction, maximizing the availability of the structure for inspection while minimizing the inherent time delay that could be created therefrom. The present invention addresses such curtain wall assembly scenario by providing a sill anchor assembly, facilitating initial installation of a sill flashing to the building's structural support surfaces and, in one embodiment, the subsequent installation of pre-glazed panel sections thereto in an assembly affording greater sealing and structural integrity therewith. The method of and apparatus for the assembly comprising the present invention further affords access to the various structural aspects of the building curtain wall with sill anchor assembly for inspection purposes prior to the completion of the installation thereof

SUMMARY OF THE INVENTION

The present invention relates to curtain walls used for building exteriors and the assembly of a building curtain wall with a sill anchor assembly. More particularly, one aspect of the present invention relates to a building curtain wall wherein a relatively light weight, extruded sill flashing is first provided for positioning, sealing and temporary securement along the structural floor sections of the building. The light weight flashing is easy to align, shim and seal and is adapted for receipt of subsequent structural panel sections in mating engagement therewith. These structural panel sections are preferably extruded aluminum members having screw splines formed therein and adapted for direct inter-engagement with fastener members extending from vertical mullions extending from opposite ends thereof. In this manner, a curtain wall panel section comprising both vertical and horizontal extruded metal sections securing a glass panel, or the like, may be assembled to the sill flashing, whereby the flashing becomes part of the structural configuration of the building curtain wall. The assembled flashing and structural member assembly is then secured directly to the building structural regions by threaded fasteners and the like for permanent securement thereto. In this manner, inspection of the structural connection may be made by a building inspector prior to the completion of the assembly which, in one aspect of the current invention includes an inside cap member.

In another aspects, the present invention relates to a building curtain wall with a sill anchor assembly utilizing extruded metal members that are adapted for interlocking engagement one with the other. A first vertical mullion section is extruded for interlocking engagement with a second extruded vertical mullion section, facilitating the assembly, sealing and structural integrity thereof at the job site. A sill assembly is provided for interconnecting the two mullion sections and comprises multiple extruded members providing direct securement to the mullion. In that regard, screw splines are formed for receiving threaded fasteners therein extending from the vertical mullions. In this fashion, the vertical mullions can be assembled directly to a sill assembly without the need for additional structural flange members, as is common in many prior art designs. Likewise, the cost and structural integrity of the assembly may be substantially improved by utilizing extruded screw splines in the manner set forth and described herein.

In a further aspect, the above-described building curtain wall with sill anchor assembly may be constructed with a first sill flashing member formed from extruded metal, and which may be secured to the building structure to receive a sill assembly in mating engagement therewith. A sill assembly may be secured directly to the underlying building's structural support surface for effecting the mounting of glass panels thereon. In that regard, sections of two part vertical mullions are specifically adapted for direct securement to opposite ends of the horizontal sill assembly. In one embodiment, the vertical mullions and sill assembly may be pre-assembled at a factory with the requisite header for installation and sealing of the glazing for subsequent securement to the sill flashing present at the job site. Due to the construction of the vertical mullions of the present invention, along with the sill anchor assembly, the vertical mullions may be rotated into interlocking engagement with one another. The securement of the sill anchor assembly between the mullions may then be effected by the drilling of apertures through the sill anchor assembly and through the sill flashing into the structural building support surface in a manner adapted for receipt of threaded fasteners therein and securement thereto. Inspection of this assembly is permitted at this stage of construction because final assembly is effected by the placement of a structural cap in engagement with and between an upstanding member of the sill flashing and an upstanding web member of the horizontal sill anchor assembly.

A sill anchor assembly adapted for securement to vertical mullions and support of a curtain wall panel of a building curtain wall, said sill anchor assembly comprising:

In yet a further aspect of the present invention, a sill anchor assembly is adapted for securement to vertical mullions and support of a curtain wall panel of a building curtain wall with the sill anchor assembly comprising a sill flashing adapted for securement to a support surface of the buildings, and a sill subassembly for mounting to the sill flashing and supporting the panel thereupon. The sill subassembly includes a sill member adapted for engagement with and securement to the flashing for the support of a panel thereon, an outside cap member adapted for interlocking engagement with the sill member in securement of the panel supported upon the sill member, and an inside cap member adapted for mating engagement with the base and the flashing to define a generally tubular structural channel formed thereby. Finally means are provided for securement of the sill member to the vertical mullion in structural interconnection therewith.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENTS

The preferred embodiment of the present invention and its advantages are best understood by referring to FIGS. 2–6 of the drawings, like numerals being used for like and corresponding parts of the various drawings.

It has been discovered that a number of advantages can be obtained by creating a sill anchor assembly for a curtain wall building system that incorporates a sill subassembly formed of extruded metal parts adapted for inter engagement one with the other and for direct structural mounting to oppositely disposed sections of vertical mullions adapted to support a panel, such as glass, placed therebetween. It has been found that the advantages of the present invention include ease in field installation by facilitating the initial installation of a first, generally light weight sill flashing directly upon the generally horizontal surface of the building upon which the curtain wall is being erected. The sill flashing is much easier to install and seal by itself. Its position on the building may then be temporarily secured by utilizing a series of fasteners. The curtain wall panel supported by a pair of oppositely disposed vertical mullions sections, a sill subassembly and a header may then be assembled, sealed and handled at the factory prior to delivery for field installation. In this manner, the chance of error and/or mishandling is greatly reduced and the cost and efficiency greatly increased. More details of this particular design and the various design aspects thereof will be set forth and shown in more detail below.

Figure 1:
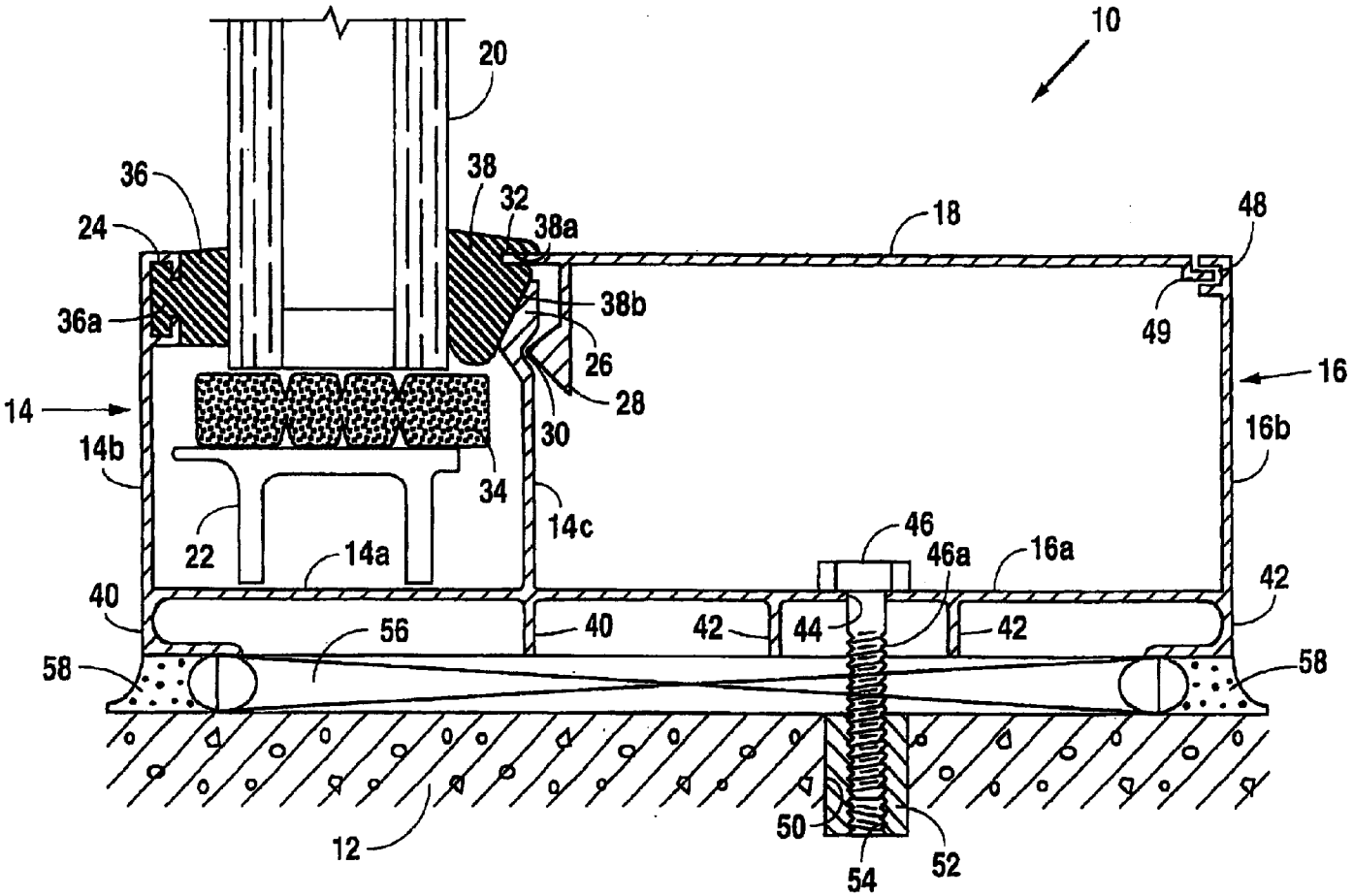
FIG. 1 (PRIOR ART)
FIG. 1 is a side-elevational, cross-sectional, schematic view of a sill member of a conventional curtain wall.
Figure 2:
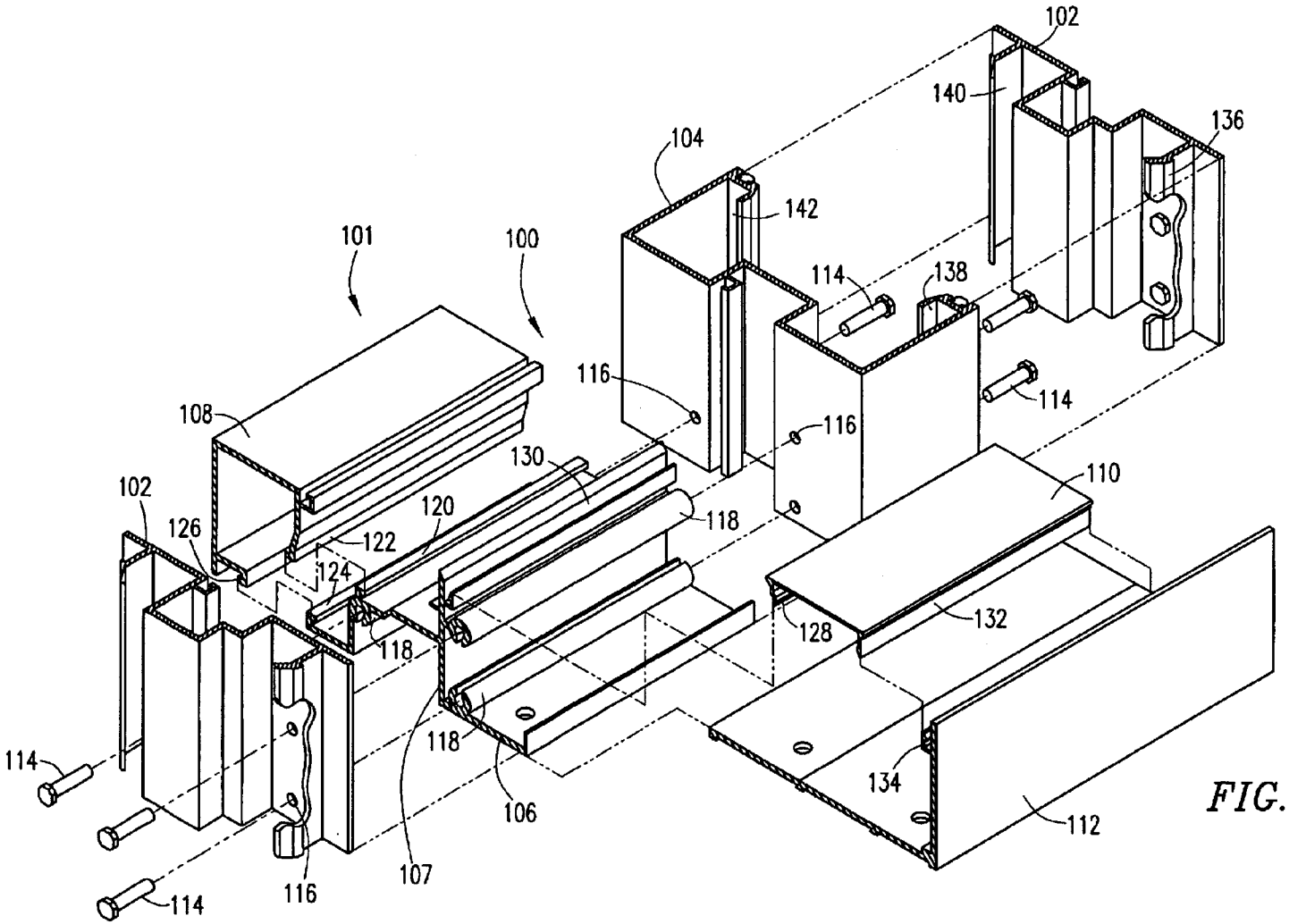
FIG. 2 is an exploded perspective view of one embodiment of a sill anchor assembly disposed between mullions of a building curtain wall constructed in accordance with the principles of the present invention.

Referring now to FIG. 2, there is shown an exploded cut-away perspective view of portions of a sill anchor assembly 100 illustrating the principles of the present invention. It should be noted that the sill anchor assembly 100 as presented herein is shown disposed between vertical mullion sections 102 and 104 for direct securement thereto, as will be defined below. The panel, which is typically glass, which is assembled between mullion sections 102 and 104 is not shown for purposes of clarity in this view. What is shown, is the innovative aspect of the sill anchor assembly 100 of the present invention, incorporating a sill subassembly 101 which affords a manufacturer ease in assembly and installation of a curtain wall panel within a building curtain wall system.

Still referring to FIG. 2, there is shown a sill member 106 preferably extruded from aluminum and configured for multiple structural and sealing applications in accordance with the principles of the present invention. Sill member 106 is constructed with an upstanding web portion 107 and is adapted for mating with other sill subassembly elements. The view of the sill anchor assembly 100, in this particular illustration, is taken from the inside of a building structure looking outwardly. In that regard, an outside cap member 108 is disposed on an outside of sill member 106 while an inside cap 110 is disposed inwardly. The sill subassembly 101 comprising caps 108 and 110, as well as sill member 106 are adapted for seating upon and mounting to sill flashing 112. As described above, the sill flashing 112 is relatively light weight in construction and is more easily handled than a heavier extruded sill assembly whereby the sill flashing 112 can be sealed against and temporarily secured to a generally horizontal surface of a building under construction while awaiting the installation of the sill subassembly 101.

Referring still to FIG. 2, the sill member 106 is adapted for receipt of fasteners 114 extending through apertures 116 formed in the mullion sections 102 and 104 disposed on opposite ends thereof. The fasteners 114 are preferably threaded fasteners conventionally used in curtain wall construction and are adapted for receipt and engagement with screw splines 118 formed as a part of sill member 106. As shown herein, three screw splines 118 are shown to be integrally formed with through extrusion of the sill member 106 and extend along the length thereof for engagement with the oppositely disposed mullion sections 102 and 104 on opposite ends of the sill member 106. Any number of screw splines may be used. It should be further noted that the length of the parts of the sill subassembly 101 are shown for reference purposes only, as are the length of the mullion sections 102 and 104. In an actual assembly, the mullion sections are of a sufficient length for defining a curtain wall panel section, as is conventionally known in the industry and the size of which is clearly shown in the patents assigned to the assignee of the present invention referred to above.

Figure 3:
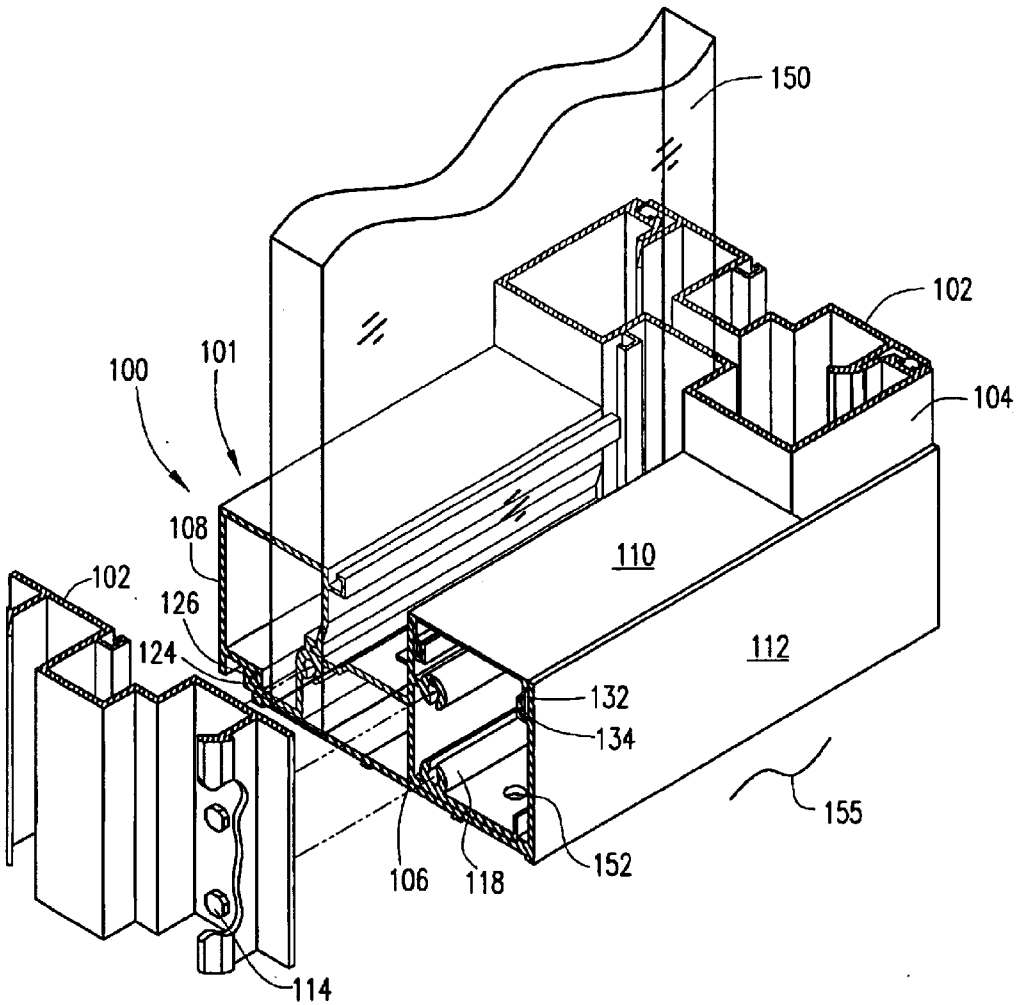
FIG. 3 is a perspective view of the sill assembly of the building curtain wall with sill anchor assembly of FIG. 2 in a stage of partial assembly illustrating the location of a panel of glass therein and further the assembly of the mullions on opposite ends thereof.

Referring now to FIG. 3, there is shown the sill anchor assembly 100 in a partial stage of assembly while the placement of a panel 150, preferably made of glass and preferably multi-paned (not shown), is placed therein. It should be noted also that the support of panel 150 within sill subassembly 101 will incorporate a variety of gaskets and seating elements that are not shown herein for purposes of clarity. It is well known in the building curtain wall art that elastomeric sealing members are utilized, as well as supporting members for glass panels necessary to insure the sealed engagement thereof relative to the curtain wall system. The present invention relates solely to the innovative design aspect shown and described herein pertaining to the sill anchor assembly 100 and therefore such elements, which could detract from the clarity of the description and illustration of the present invention, are not shown. What is shown is the assembled configuration of mullion sections 102 and 104 together in engagement with a first end of sill member 106 with inside and outside caps 110 and 108, respectively, shown secured thereto for purposes of illustration. It should be noted that inside cap 110 would not be secured as shown until the sill subassembly 101 is permanently secured through the sill flashing 112 to the underlying support surface as described below.

Referring still to FIG. 3, a sill anchor bolt head 152 is partially shown illustrating the passage of a threaded fastener through a lower region of the sill member 106 and through the lower region of sill flashing 112 into the underlying structural support area of the sill subassembly 101. Likewise, fasteners 114 are shown disposed within the mullion section 102 extending toward the screw splines 118 of sill member 106. It is by the utilization of fasteners 114, which are preferably threaded, that provide ease in the installation of the mullion sections 102 and 104. Since the mullion sections are separate one from the other for purposes of installation, the manner of securement of the mullion sections 102 and 104 to the sill subassembly 101 is greatly facilitated. Likewise, aspects of sealing, alignment and related assembly techniques can be more accurately addressed in an environment such as a factory, rather than the job site, when it is desirable to complete an entire building curtain wall panel assembly at the factory for purposes of field installation. The lower portion of this assembly is that shown in FIG. 3, and would be completed by utilizing the appropriate lengths of the members of sill anchor assembly 100, as well as mullion sections 102 and 104, along with the appropriate header extending thereacross along the upper perimeter thereof as described below.

Figure 4:
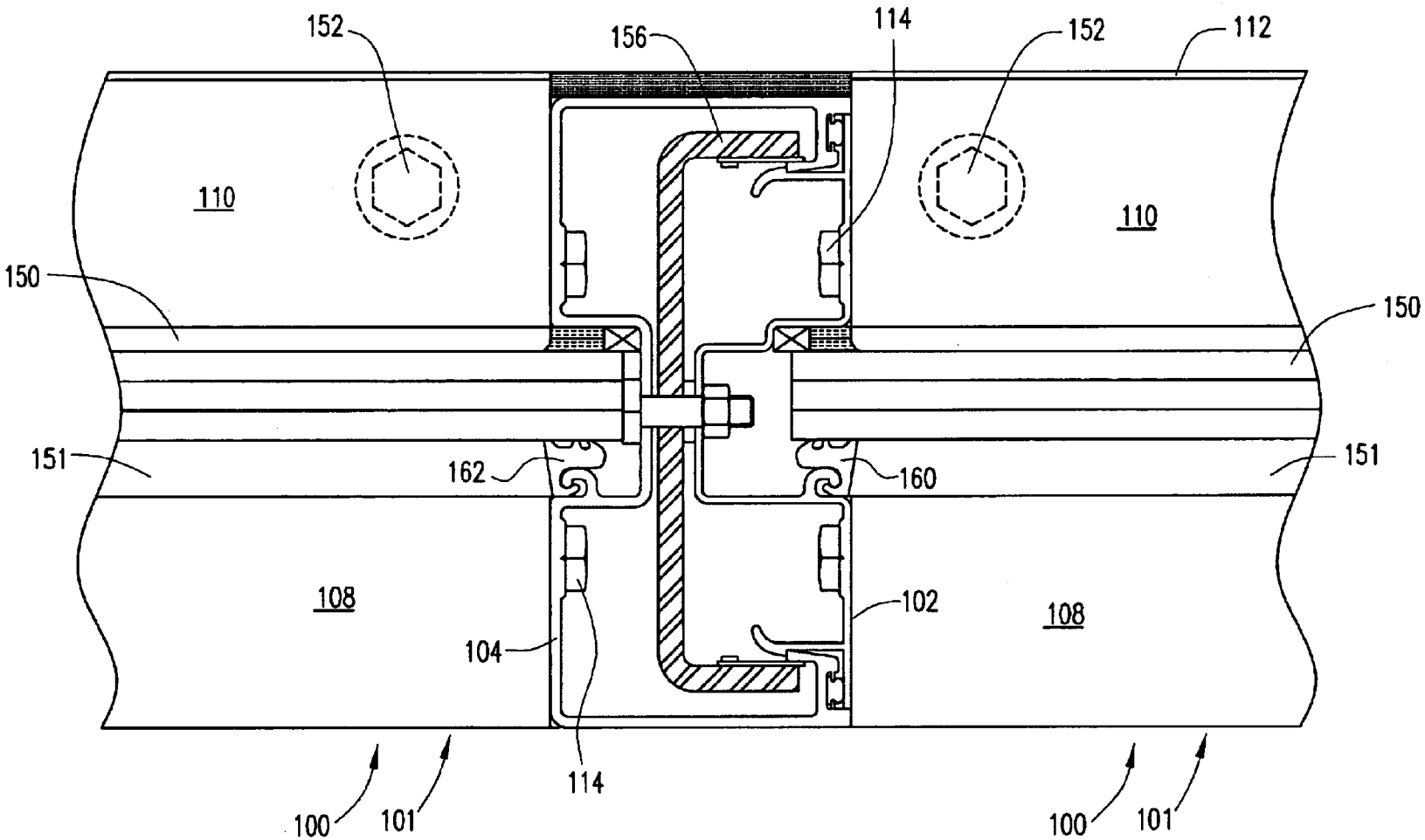
FIG. 4 is a top plan, cross sectional view of the building curtain wall with sill anchor assembly of FIG. 2 in a completed stage of assembly and illustrating the mullion sections thereof assembled one to the other in engagement with a structural curtain wall support therebetween.

Referring now to FIG. 4, there is shown a top plan view of a pair of sill anchor assemblies 100 constructed in accordance with the principles of the present invention as assembled into building curtain wall panel sections assembled contiguous one another. It may be seen that mullion section 102 is shown to be in interlocking engagement with mullion section 104 while glass panels 150 are secured therein. It may be seen that the mullion sections 102 and 104 are likewise secured to a structural member 156, typically made of steel and positioned as a structural member within the building for support of the curtain wall. As set forth above, a fill description of curtain wall assembly and the support thereof relative to a building is fully set forth and shown in the above described patents of the assignee of the present invention which are incorporated herein by reference.

Still referring to FIG. 4, it may be seen that in this particular view, the sill subassembly 101 has been completely assembled and the inside caps 110 are in position adjacent the vertical mullion sections 102 and 104. Shown in dotted line are the threaded fasteners 152 which are present therebeneath and securement of the sill subassembly 101 and sill flashing 112 to the underlying building support surface, as shown more clearly in FIG. 6. Likewise, outside caps 108 are presented in securement of the glass panels 150 therein by elastomeric gaskets 151. It is typical in the construction of curtain wall assemblies to utilize elastomeric members to position the glass panels 150 and seal the junction thereof against water and air infiltration. These aspects are shown herein for purposes of illustration, and the elastomeric gasket 151 is shown in cross-section and more clearly in FIG. 6.

Figure 5:
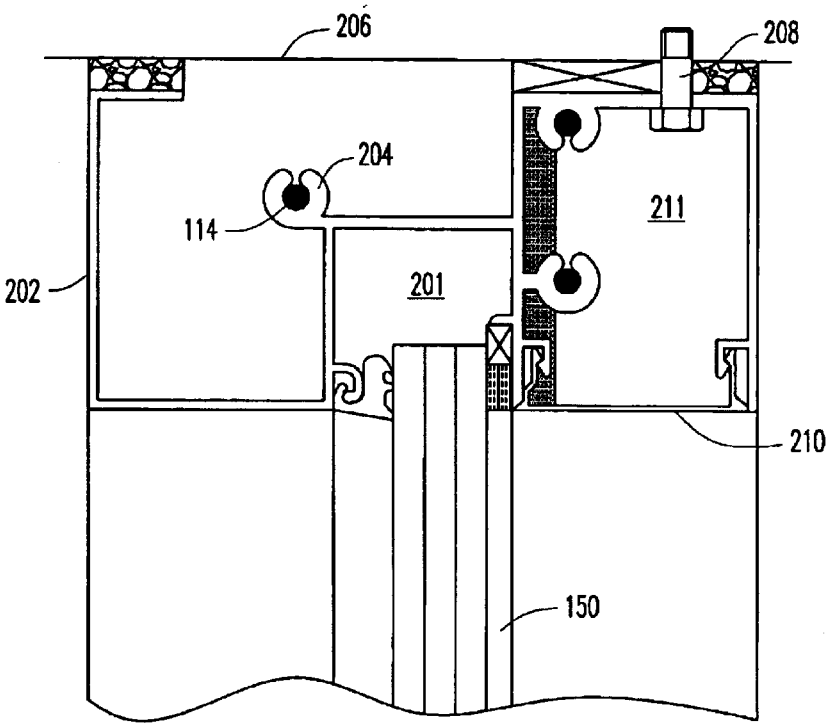
FIG. 5 is a side-elevational, cross-sectional view of the upper region of the building curtain wall panel section of FIG. 4 illustrating a header for use therewith to define a panel section therefrom, consistent with the sill anchor assembly of FIG. 2.

Referring now to FIG. 5, there is shown a side-elevational cross-sectional view of the upper region of a curtain wall panel assembly of the type utilizing the sill anchor assembly 100 of the present invention. In that regard, the glass panel 150 which has been described above, is positioned within a pocket 201 formed within a header 202 constructed with screw splines 204 therein. It is suggested that the header 202 is preferably extruded from aluminum, as is taught in the fabrication of the sill assembly. The header 202 is formed complementary to the innovative sill anchor assembly of FIG. 2. The header, in this particular embodiment, only incorporates two parts, but in those two parts it directly incorporates the screw splines 204 that permit direct securement to the vertical mullion section and the load distribution therefrom, as describe above. The header 202 also requires an inside cap 210 which provides a covering of the chamber 211 defined thereby, which chamber affords access to threaded fastener 208 which extends therefrom into the ceiling 206.

Still referring to FIG. 5, the header 202 is shown to be of unitary construction, preferably extruded into the configuration shown, with the only additional element being the inside cap 210 interconnected therewith. The general shape of the header 202 is similar to that of the sill subassembly 101 described herein, but without the necessity of the various interlocking parts thereof due to the particular manner of installation of the glass panel 150 into the header. It should be noted that the darkened regions within the screw splines 204 represent fasteners 114 extending from the vertical mullion sections for the support thereof. As with the sill subassembly 101, the load distribution from the mullion section is directly transferred through the fasteners 114 into the screw splines 204 and header 202, as they are in fasteners 114 into screw splines 118 of sill subassembly 101.

Figure 6:
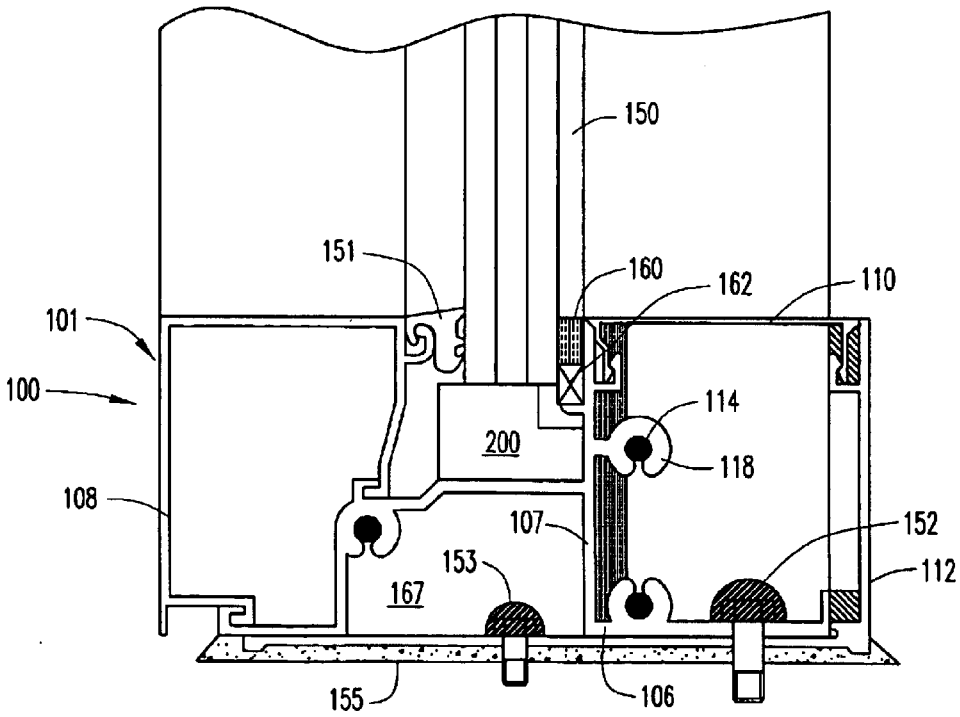
FIG. 6 is a side-elevational, cross-sectional view of the sill anchor assembly of FIG. 2 illustrating various assembly features thereof.

Referring now to FIG. 6, there is shown a side-elevational cross-sectional view of the assembled sill subassembly 101 supporting the lower region of glass panel 150, the upper portion of which is shown in FIG. 5. In this particular embodiment, a setting block 200 is set forth and shown for purposes of illustration. The setting block 200 supports the glass panel 150 as shown herein. In similar manner, an elastomeric gasket 151 is shown positioned between the outside cap 108 and the frontal portion of the glass panel 150. Immediately opposite elastomeric gasket 151 and behind the glass panel 150 is structural silicon 160, shown for purposes of sealing therewith. Structural silicon 160 is set atop the spacer 162, resting upon a portion of the upstanding web portion 107 of sill member 106 described relative to FIG. 2.

Still referring to FIG. 6, temporary fasteners 153 are shown positioning the sill flashing 112 into the underlying support surface 155. The position of the fastener 153 is shown to be within the void 167 formed beneath the web portions of the sill member 106 facilitating clearance for the fastener 153. Likewise, fastener 152, the top of which is shown in FIG. 3, is shown to penetrate both the sill member 106, as well as the sill flashing 112 into the underlying support surface 155 to secure the sill subassembly 101 thereto.

In operation, the sill anchor assembly 101 shown in FIGS. 2–6 (and referred to in combination herewith) are assembled to the vertical mullion sections 102 and 104 of building curtain walls for support of curtain wall panels, such as glass panel 150. The method of assembly comprises the steps of providing the sill flashing 112 adapted for securement to a support surface 155 of the building. The sill subassembly 101 is provided for mounting to the sill flashing 112 and supporting one of the panels 150 thereupon. The steps of providing the sill subassembly includes the steps of providing a sill member 106, securing the vertical mullions 102 and 104 to opposite ends of the sill member, providing an outside cap member 108, positioning the panel 150 between the mullions 102 and 104 and upon the sill member 106, interlocking the outside cap member 108 with the sill member in securement of the panel supported thereby, positioning the sill member panel and mullions assembled thereto on the flashing, providing an inside cap member 110, securing the sill member and the underlying sill flashing 112 to the support surface 155 of the building, and securing the inside cap member 110 in engagement with a portion of the sill member and a portion of the sill flashing to thereby define a generally tubular, structural channel therewith. This method can be effective in reducing costs and increasing efficiency and may permit the entire panel assembly of sill subassembly 101, mullion sections 102 and 104, header 202 and panel 150 to be assembled at a factory for ease in installation at the job site. It may be noted that only the sealed, temporarily secured sill flashing (using fasteners 153) need to be installed ahead of this process.

Still referring to FIGS. 2–6 in combination, the above-described method affords greater flexibility and ease in fabricating, assembling and installing the curtain wall sections, as defined herein. Of particular assistance is the fact that the inside cap 110 of sill subassembly 101 and the inside cap 210 of header 202 may both be installed after the respective fasteners have secured the respective sill and header assemblies to the respective surfaces of the building, and after official inspection of same. In the instance of the securement of the flashing 112 to the building surface 155, as shown in FIG. 6, the use of the preliminary securement fastener 153 facilitates positioning of the sill flashing 112 about the surface 155 against which it may be sealed and/or shimmed if necessary and permits the installation of the entire panel section as described herein, including the sill subassembly 101, mullion sections 102 and 104, header 202 and panel 150 as an entire unit. As further described herein, it may be noted that due to the interlocking configuration of the mullion sections 102 and 104, this installation and interlocking engagement of the mullion sections 102 and 104 may be easily facilitated at the job site with a minimal amount of additional labor. This advantage reduces costs and increases efficiency.

It is thus believed that the operation and construction of the present invention will be apparent from the foregoing description. While the method and apparatus shown or described have been characterized as being preferred it will be obvious that various changes and modifications may be made therein without departing from the spirit and scope of the invention as defined in the following claims.

What is claimed is:

1. A sill anchor system for a building curtain wall, said sill anchor system comprising:

at least one vertical mullion for securement to a surface of said building:

a sill flashing, being constructed with an upstanding inside portion having a flanged section formed therein, adapted for securement to a support surface of said building;

a sill subassembly for mounting to said sill flashing and supporting said panel thereupon, said sill subassembly including, a sill member, being formed with an intermediate web portion upstanding therealong and having a flange region formed therein adapted for engaging a second, opposite portion of a generally U-shaped channel forming an inside cap member, said sill member further adapted for engagement with and securement to said flashing for the support of a panel thereon;

an outside cap member adapted for interlocking engagement with said sill member in securement of said panel supported upon said sill member;

an inside cap member, constructed in a generally U-shaped configuration, adapted for mating engagement with said sill member and said flashing to define a generally tubular structural channel formed thereby;

means for securement of said sill member to said vertical mullion in structural interconnection therewith; and wherein said sill flashing is further adapted for mating with an inside portion of said generally U-shaped channel.

2. The sill system as set forth in claim 1 wherein said subassembly members are extruded metal sections adapted for mating engagement one with the other.

3. The sill system as set forth in claim 2 wherein said sill subassembly members and said at least one vertical mullion are extruded from aluminum and said sill system further comprises a curtain wall panel comprising glass.

4. The sill system as set forth in claim 1 wherein said sill member comprises a metal extrusion formed with screw splines disposed in generally parallel spaced relationship therealong, said screw splines adapted for abutting engagement with said vertical mullion for receiving fasteners therethrough, facilitating said structural engagement therewith.

5. The sill system as set forth in claim 4 wherein said sill member is formed with a plurality of screw splines extruded therealong, said screw splines being adapted for receipt of threaded fasteners therein and said securement means including said threaded fasteners.

6. The sill system as set forth in claim 1 wherein said generally U-shaped cap member further includes generally parallel spaced, interlocking leg portions that are positioned for interlocking engagement with said upstanding flanged sections of said sill web portion and said sill flashing to thereby define a generally rectangular tubular structure therealong in abutting engagement with a portion of said vertical mullion secured thereto.

7. The sill system as set forth in claim 1 wherein said at least one vertical mullion comprises at least two mullion sections adapted for interengagement one with the other, a first mullion section being adapted for abutting engagement against a first end of said sill subassembly for securement thereto, and a second mullion section being adapted for abutting engagement against a second end of said sill sub-assembly.

8. The sill assembly system as set forth in claim 7 wherein said sill member is extruded with a plurality of screw splines formed therealong and said securement means for said at least one vertical mullion include a plurality of screws extending through portions of said vertical mullions into said screw splines.

9. A method of assembling a sill anchor assembly and vertical mullions of a building curtain wall for support of curtain wall panels, said building having a plurality of generally horizontal surfaces for support of said sill assembly and said method comprising the steps of:

providing a sill flashing adapted for securement to a support surface of said building;

providing a sill subassembly for mounting to said sill flashing and supporting one of said panels thereupon, said step of providing said sill subassembly including, providing a sill member;

securing said vertical mullions to opposite ends of said sill member;

providing an outside cap member;

positioning said panel between said mullions and upon said sill member;

interlocking said outside cap member with said sill member in securement of said panel supported thereby;

positioning said sill member panel and mullions assembled thereto on said flashing;

providing an inside cap member;

securing said sill member and said sill flashing to said support surface of said building; and securing said inside cap member in engagement with a portion of said sill member and a portion of said sill flashing to thereby define a generally tubular, structural channel therewith.

10. The method as set forth in claim 9 and further including the step of forming said subassembly members by extrusion.

11. The method as set forth in claim 10 and further including the steps of extruding said sill subassembly members from aluminum and forming said curtain wall panels from glass.

12. The method as set forth in claim 9 and further including the steps of:

extruding said sill member with screw splines disposed in generally parallel spaced relationship therealong, said screw splines being adapted for abutting engagement with a vertical mullion for receiving fasteners therethrough, facilitating said structural engagement therewith;

and engaging said sill member with said vertical mullion via said screw splines.

13. The method as set forth in claim 12 and further including the step of extruding said sill member with a plurality of screw splines therealong.

14. The method in claim 9 and further including the steps of:

extruding said inside cap member in a generally U-shaped configuration;

forming said sill flashing with an upstanding inside portion having a flanged section formed therein adapted for mating with an inside portion of said generally U-shaped channel;

further extruding said sill member with an intermediate web portion upstanding therealong with a flange region formed therein adapted for engaging a second opposite portion of said generally U-shaped channel forming said inside cap member; and engaging said second opposite portion of said generally U-shaped channel via said flange region.

15. The method as set forth in claim 14 and further including the steps of:

extruding said generally U-shaped cap member with generally parallel spaced interlocking leg portions that are positioned for interlocking engagement with said upstanding flanged sections of said sill web portion and said sill flashing to thereby define a generally rectangular tubular structure therealong in abutting engagement with a portion of said vertical mullion secured thereto; and interlocking said interlocking leg portion with said upstanding flanged sections.

16. The method as set forth in claim 9 and further including the steps of:

extruding said vertical mullion in at least two mullion sections each adapted for interengagement with the other, a first mullion section being adapted for abutting engagement against a first end of said sill subassembly for securement thereto, and a second mullion section being adapted for abutting engagement against a second end of said sill sub-assembly;

engaging said first mullion section with said first end of said sill subassembly; and engaging said second mullion section against said second end of said sill sub-assembly.

17. The method as set forth in claim 16 and further including the step of extruding said sill member with a plurality of screw splines formed therealong and the step of securing said vertical mullion sections to said sill member with a plurality of screws extending through a portion of said vertical mullion into said screw splines.

18. The method of installing curtain wall panels in a building curtain wall of the type wherein said curtain wall panels are secured to generally horizontal mounting surfaces with vertical mullions extending therebetween, said method comprising the steps of assembling said curtain wall panels with sill subassemblies extending between oppositely disposed vertical mullion sections adapted for mating engagement one with another;

providing a sill flashing adapted for receipt of said sill subassemblies thereon;

positioning said sill flashing on said support surfaces of said building;

mounting said sill subassemblies of said panel assemblies of said curtain wall sections to defined portions of said sill flashing;

interlocking adjacent vertical mullions of adjacent curtain wall panel assemblies;

securing said sill subassembly of said panel assemblies into said building support surface through said flashing while maintaining said interlocking relationship between said adjacent vertical mullions;

forming said sill subassembly members by extrusion;

providing said sill subassembly with a sill member for positioning on said flashing, an outside cap member and an inside cap member adapted for engagement with a portion of said sill member and a portion of said sill flashing to thereby define a generally tubular, structural channel therewith; and engaging the inside cap member with the portion of said sill member and said sill flashing.

19. The method as set forth in claim 18 and further including the steps of extruding said sill subassembly members from aluminum and forming said curtain wall panels from glass.

20. The method as set forth in claim 18 and further including the steps of:

extruding said sill member with screw splines disposed in generally parallel spaced relationship therealong, said screw splines being adapted for abutting engagement with a vertical mullion for receiving fasteners therethrough, facilitating said structural engagement therewith; and engaging said vertical mullion with said sill member via said screw splines.

21. The method as set forth in claim 20 and further including the step of extruding said sill member with a plurality of screw splines therealong.

22. The method in claim 18 and further including the steps of:

extruding said inside cap member in a generally U-shaped configuration;

forming said sill flashing with an upstanding inside portion having a flanged section formed therein adapted for mating with an inside portion of said generally U-shaped channel;

further extruding said sill member with an intermediate web portion upstanding therealong with a flange region formed therein adapted for engaging a second opposite portion of said generally U-shaped channel forming said inside cap member; and engaging said second opposite portion of said generally U-shaped channel via said flange region.

23. The method as set forth in claim 22 and further including the steps of:

extruding said generally U-shaped cap member with generally parallel spaced interlocking leg portions that are positioned for interlocking engagement with said upstanding flanged sections of said base web portion and said sill flashing to thereby define a generally rectangular tubular structure therealong in abutting engagement with a portion of said vertical mullion secured thereto; and interlocking said interlocking leg portion with said upstanding flanged sections.

24. The method as set forth in claim 18 and further including the steps of:

extruding said vertical mullion in at least two mullion sections each adapted for interengagement with the other, a first mullion section being adapted for abutting engagement against a first end of said sill subassembly for securement thereto, and a second mullion section being adapted for abutting engagement against a second end of said sill sub-assembly for securement thereto;

engaging said first mullion section with said first end of said sill subassembly; and engaging said second mullion section against said second end of said sill sub-assembly.

25. The method as set forth in claim 24 and further including the step of extruding said sill member with a plurality of screw splines formed therealong and the step of securing said vertical mullion sections to said sill member with a plurality of screws extending through a portion of said vertical mullion into said screw splines.

* * * * *

UNITED STATES PATENT AND TRADEMARK OFFICE

CERTIFICATE OF CORRECTION

PATENT NO. : 6,715,248 B2
DATED : April 6, 2004
INVENTOR(S) : Lawrence Biebuyck

It is certified that error appears in the above-identified patent and that said Letters Patent is hereby corrected as shown below:

Column 2,
Line 58, replace “member 22.” with -- member 20. --

Column 3,
Line 32, replace “thereof” with -- thereof. --

Column 5,
Line 34, replace “inter engagement” with -- interengagement --

Column 7,
Line 32, replace “a fill description” with -- a full description --

Signed and Sealed this

Thirty-first Day of August, 2004

JON W. DUDAS
*Director of the United States Patent and Trademark Office*